US005813484A

United States Patent [19]

Ekström

[11] Patent Number: 5,813,484

[45] Date of Patent: Sep. 29, 1998

[54] CASING TUBE WITH CASING SHOE

[75] Inventor: Ross Christian Ekström, Sunne, Sweden

[73] Assignee: Atlas Copco Craelius AB, Marsta, Sweden

[21] Appl. No.: 732,309

[22] PCT Filed: Apr. 21, 1995

[86] PCT No.: PCT/SE95/00434

§ 371 Date: Mar. 31, 1997

§ 102(e) Date: Mar. 31, 1997

[87] PCT Pub. No.: WO95/29321

PCT Pub. Date: Nov. 2, 1995

[30] Foreign Application Priority Data

Apr. 21, 1994 [SE] Sweden ..... 9401349

[51] Int. Cl.[6] ..... E21B 17/10

[52] U.S. Cl. ..... 175/325.2; 175/293

[58] Field of Search ..... 175/293, 325.2, 175/325.1, 320, 321, 325.5

[56] References Cited

U.S. PATENT DOCUMENTS

| | | | |
|---|---|---|---|
| 3,212,582 | 10/1965 | Brown | 166/242 |
| 3,991,834 | 11/1976 | Curington | 175/215 X |
| 4,146,060 | 3/1979 | Garrett | 175/325.2 X |
| 4,729,437 | 3/1988 | Zapico . | |
| 4,867,266 | 9/1989 | Martin | 175/1 X |
| 4,878,549 | 11/1989 | Bennet . | |

FOREIGN PATENT DOCUMENTS

| | | |
|---|---|---|
| 464600 | 1/1992 | European Pat. Off. . |
| 1927672 | 12/1970 | Germany . |

*Primary Examiner*—Frank Tsay
*Attorney, Agent, or Firm*—Mark P. Stone

[57] ABSTRACT

A casing tube formed from plastic and a casing shoe formed from metal are provided for drilling in layers of earth or rock. The casing shoe is locked to the casing tube by threads, grooves or flanges provided on a reduced diameter portion of the casing shoe. A tube-formed extension is provided in the casing shoe for protecting the casing tube from damage during a drilling operation.

5 Claims, 2 Drawing Sheets

CASING TUBE WITH CASING SHOE

BACKGROUND OF THE INVENTION

The present invention relates to a casing tube with casing shoe, usually called starting tube, for use at drilling through earth layers or rock by means of impact drilling.

In a prior art device, see WO 93/17215, a casing shoe of metal provided with holes filled with plastic from the casing tube is used. A drawback with this design is that it is difficult to join long casing tubes with the casing shoe in a one step process. Another drawback is that drill cuttings can hurt the casing tube prematurely at the transition to the casing shoe. The drill cuttings exert a certain blasting caused by change of direction of the cuttings flow in this section.

SUMMARY OF THE INVENTION

The present invention, which is defined in the appended claims, aims at making it possible to join casing tubes of normal length to the casing shoe in a one step process. This is achieved by providing the casing shoe with threads, grooves or flanges adapted to grip into the plastic material of the casing tube so as to lock the casing shoe in the plastic material against axial movement and/or rotation relative to the casing tube. This makes it possible to shrink the casing tube on the casing shoe without making the plastic material liquid, which is necessary if the plastic material is to flow through holes in the casing shoe and join on the inside thereof. With the invention it is also possible to use extrusion, casting or other methods for joining casing shoe and casing tube.

According to an advantageous embodiment of the invention the casing shoe is provided with a tubeformed extension which extends into the casing tube behind its joint with the casing shoe. This extension prevents the drill cuttings from damaging the casing tube at the transition between casing shoe and casing tube by preventing drill cuttings from being pressed against the casing tube by a relatively to the casing tube rotating guide for the drill bit.

BREIF DESCRIPTION OF THE DRAWINGS

Figure 1:
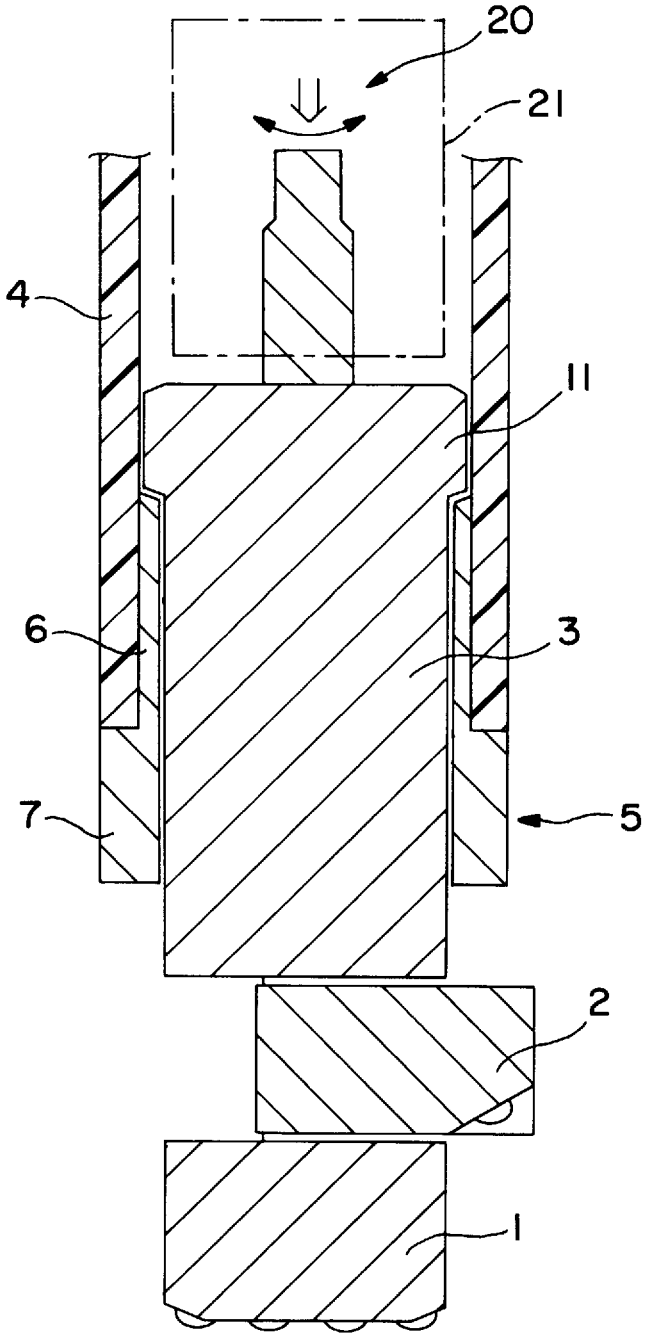
Figure 2:
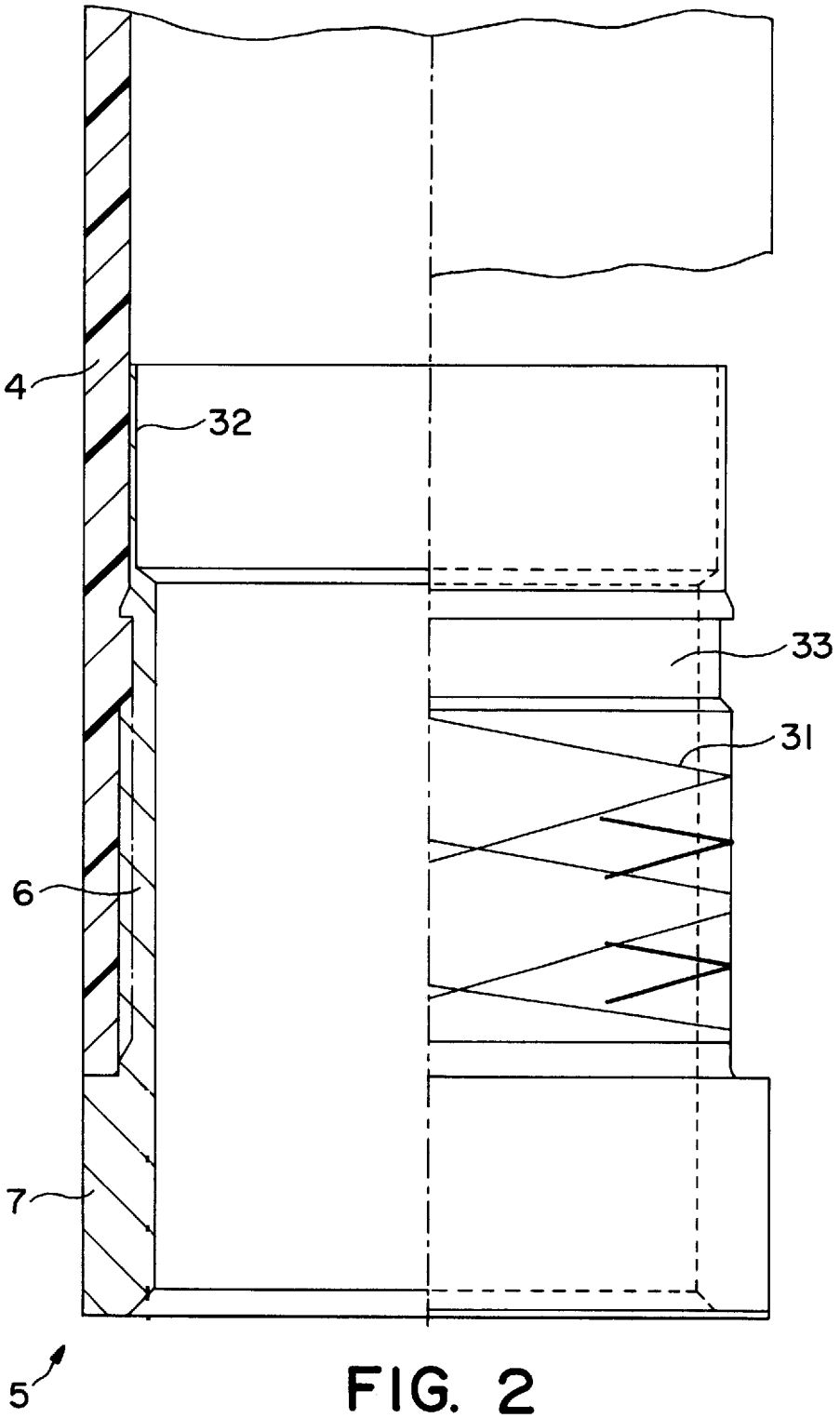

An embodiment of the invention is described below with reference to the accompanying drawings in which FIG. 1 schematically shows a drilling device in which the invention forms a part. FIG. 2 shows on a larger scale a casing tube wih casing shoe according to the invention.

DESCRIPTION OF THE BEST MODES FOR CARRYING OUT THE INVENTION

The drilling device shown in FIG. 1 comprises a drill bit comprising a pilot bit 1 and a pivotable reamer 2. The drill bit is exerted to impacts from a guide 3 arranged in a down-the-hole drilling machine 21. The drill bit is pressed against the ground and rotated in the usual way as indicated by the arrows 20. A casing tube with casing shoe comprising a casing shoe 5 and casing tube 4 connected with the casing shoe is driven into the ground, which can be an earth layer or rock or another similar material, by hitting the upper part of the casing shoe with a flange 11 on the guide 3. Instead of a down-the-hole drilling machine one can use a top hammer drilling machine outside the drill hole. The casing shoe comprises a part 7, turned away from the casing tube 4, with substantially the same outer diameter as the casing tube and a part 6 with reduced diameter. Part 6 is on its outer side provided with threads 31, in the shown example both left hand threads and right hand threads, i.e. threads with opposite pitch, and a groove 33. Alternatively one can provide the casing shoe with only grooves and/or flanges or threads with variable pitch to lock the casing tube to the casing shoe. In order to fasten a casing tube of normal length to the casing shoe one can suitably warm the end of the tube so that it is widened and then press the casing shoe into it. When the casing tube is cooled a connection is obtained through cooperation between the plastic material and the threads 31 and the groove 33.

In the prior art device the flow of drill cuttings at the rear end of the casing shoe in combination with the rotation of the guide causes blasting of the casing tube. The casing shoe according to FIG. 2 is provided with a tubeformed extension 32 which prevents drill cuttings from hurting this section.

I claim:

1. A casing tube having a casing shoe for drilling layers of earth or rock by means of impact drilling, said casing shoe (5) being formed from metal, and said casing tube (4) being formed from plastic and fastened to said casing shoe, said casing shoe having a first portion (7) thereof having an outer diameter substantially the same as that of said casing tube, said casing shoe having a second portion (6) thereof to which said casing tube is fastened, said second portion of said casing shoe having a diameter less than said diameter of said first portion of said casing shoe, wherein said second portion of said casing shoe defines threads for locking said casing shoe (5) to said casing tube (4); said casing shoe being provided with a tubeformed extension (32) which extends into the casing tube (4) for protecting said casing tube along a region at which said casing tube is fastened to said casing shoe.

2. The casing tube as claimed in claim 1 wherein said threads defined on said second portion of said casing shoe are of opposite pitch.

3. The casing tube as claimed in claim 1 wherein said threads defined on said second portion of said casing shoe are of variable pitch.

4. A casing tube having a casing shoe for drilling layers of earth or rock by means of impact drilling, said casing shoe (5) being formed from metal, and said casing tube (4) being formed from plastic and fastened to said casing shoe, said casing shoe having a first portion (7) thereof having an outer diameter substantially the same as that of said casing tube, said casing shoe having a second portion (6) thereof to which said casing tube is fastened, said second portion of said casing shoe having a diameter less than said diameter of said first portion of said casing shoe, wherein said second portion of said casing shoe defines at least one groove for locking said casing shoe (5) to said casing tube (4); said casing shoe being provided with a tubeformed extension (32) which extends into the casing tube (4) for protecting said casing tube along a region at which said casing tube is fastened to said casing shoe.

5. A casing tube having a casing shoe for drilling layers of earth or rock by means of impact drilling, said casing shoe (5) being formed from metal, and said casing tube (4) being formed from plastic and fastened to said casing shoe, said casing shoe having a first portion (7) thereof having an outer diameter substantially the same as that of said casing tube, said casing shoe having a second portion (6) thereof to which said casing tube is fastened, said second portion of said casing shoe having a diameter less than said diameter of said first portion of said casing shoe, wherein said second portion of said casing shoe defines at least one flange for locking said casing shoe (5) to said casing tube (4); said casing shoe (5) being provided with a tubeformed extension (32) which extends into the casing tube (4) for protecting said casing tube along a region at which said casing tube is fastened to said casing shoe.

* * * * *